US005353044A

United States Patent [19]

Nakano et al.

[11] Patent Number: 5,353,044

[45] Date of Patent: Oct. 4, 1994

[54] SYSTEM FOR PREVENTING ABNORMAL HEATING OF THERMAL HEAD

[75] Inventors: Akira Nakano, Hachioji; Keiji Ameno, Kunitachi, both of Japan

[73] Assignee: Kabushiki Kaisha Toshiba, Kawasaki, Japan

[21] Appl. No.: 856,746

[22] Filed: Mar. 24, 1992

[30] Foreign Application Priority Data

Mar. 26, 1991 [JP] Japan ..... 3-084555

[51] Int. Cl.[5] ..... B41J 2/35; B41J 2/375; B41J 2/36; B41J 2/365

[52] U.S. Cl. ..... 346/76 PH

[58] Field of Search ..... 346/76 PH; 400/120

[56] References Cited

U.S. PATENT DOCUMENTS 4,704,618 11/1987 Gotoh et al. ..... 346/76 PH
4,736,089 4/1988 Hair et al. ..... 346/76 PH X
4,873,536 10/1989 Minowa et al. ..... 346/76 PH
5,162,813 11/1992 Kuroiwa et al. ..... 346/76 PH X

FOREIGN PATENT DOCUMENTS 0116168 5/1987 Japan ..... 346/76 PH

*Primary Examiner*—Benjamin R. Fuller
*Assistant Examiner*—Huan Tran
*Attorney, Agent, or Firm*—Finnegan, Henderson, Farabow, Garrett & Dunner

[57] ABSTRACT

A system for preventing abnormal heating of a thermal head, which is configured with pure hardware. In the system, when a temperature of the thermal head becomes an abnormally high temperature exceeding a predetermined temperature and/or an active time of a print-time setting signal cyclically issued from a microcomputer for activating the thermal head only for a time period necessary for printing of one line of picture image becomes abnormally long, a flip-flop is set so that three sorts of switch circuits are respectively operated in such a manner as follows, whereby the abnormal heating of the thermal head can be prevented at a very high reliability.

(1) The supply of a drive voltage to the thermal head for heating the thermal head is forcibly stopped.

(2) The input of the print-time setting signal to the thermal head is forcibly stopped.

(3) A picture image signal supplied from the microcomputer to the thermal head is cut off and, instead of the picture image signal from the microcomputer, a signal indicative of a non-printing picture image, e.g., all-white picture image, is forcibly supplied to the thermal head as the picture image signal.

27 Claims, 5 Drawing Sheets

SYSTEM FOR PREVENTING ABNORMAL HEATING OF THERMAL HEAD

BACKGROUND OF THE INVENTION

1. Field of the Invention

The present invention relates to an abnormal heating prevention system for preventing abnormal heating of a thermal head used in a thermal printer and more particularly, to an embodiment of such an abnormal heating prevention system which is configured in the form of pure hardware to prevent the abnormal heating of a thermal head with a high reliability.

2. Description of the Related Art

Many facsimile machines or the like have conventionally been mounted with a thermal printer as its printing device. Such a thermal printer has had such a problem that, since the printer prints data on thermal sensitive paper or on ordinary paper through ink ribbon by electrically and directly heating an array of heating resistors of a thermal head, if an abnormal current flows through the heating resistors, then the thermal head or the recording paper is abnormally heated, which undesirably might lead to fire.

As a major cause of the problem, there may be considered that the runaway or the like of a microcomputer built in the thermal head as a printing controller causes a print-time setting signal to be maintained to be continuously active without any interruption, though the print-time setting signal is set to provide a heating drive time to the heating resistor array for each line of picture image and is set to normally be active for only each printing period of the signal.

To avoid this problem, there has been proposed an abnormal heating prevention system in which switch means for forcibly cutting off the power supply to the heating resistors is previously provided so as to be turned OFF when such an abnormally long active time of the print-time setting signal or an abnormally high thermal head temperature is detected, thereby preventing the abnormal heating of the thermal head.

The prior art system, however, has a difficulty that, since the aforementioned abnormal-heating preventing operation is carried out under control of the aforementioned printing control microcomputer, if a software program itself describing the processing procedure based on the microcomputer runs out of control, then the above remedy becomes useless. That is, even turning OFF the switch means becomes difficult and the positive prevention of the abnormal heating of the thermal head cannot be guaranteed.

SUMMARY OF THE INVENTION

In view of such circumstances, it is an object of the present invention to provide an abnormal heating prevention system which can positively prevent a thermal head from being abnormally heated even when a microcomputer runs out of control.

In order to attain the above object, in accordance with a basic aspect of the present invention, an abnormal heating prevention system is configured in the form of pure hardware. In accordance with a preferable aspect of the present invention into be detailed later), an abnormal heating prevention system comprises:

(a) first detection circuit for detecting an abnormal high temperature of a thermal head exceeding a predetermined temperature;

(b) a second detection circuit for detecting an abnormally long active time of a print-time setting signal issued from a microcomputer cyclically so as to be active for a time period necessary for printing of one line of picture image;

(c) a stop signal output circuit for outputting a recording stop signal when an abnormality is detected by one or both of the first and second detection circuits;

(d) a first switch circuit for forcibly stopping supply of a drive voltage to the thermal head in response to the output of the recording stop signal;

(e) a second switch circuit for forcibly stopping the input of the print-time setting signal to the thermal head in response to the output of the recording stop signal; and (f) a third switch circuit for interrupting a picture image signal supplied from the microcomputer to the thermal head in response to the output of the recording stop signal and for forcibly supplying, instead of the picture image signal from the microcomputer, a signal indicative of a non-printing picture image (e.g., all-white picture image) to the thermal head as the picture image signal.

In more detail, the first switch circuit acts to stop the power supply to the thermal head to thereby prevent the further heating of the thermal head; the second switch circuit acts to stop the input of the print-time setting signal to the thermal head, that is, to stop the printing operation of the thermal head to thereby prevent the further heating thereof even when the power supply to the thermal head is maintained; and the third switch circuit acts to allow the printing of a non-printing picture image such as an all-white picture image, i.e., to inhibit the substantial image printing to thereby prevent the further heating of the thermal head, even when the power supply to the thermal head is maintained or the print-time setting signal is applied to the thermal head to put the thermal head in its printable state.

In addition, the operation of these switch circuits depends only on the presence or absence of the recording stop signal issued from the stop signal output circuit and is independent of the operation of the printing control microcomputer itself.

For this reason, even when the microcomputer runs out of control away for some reason, which leads to generation of an abnormality that the thermal head is abnormally heated to such a high temperature exceeding a predetermined level and/or that the active time of the print-time setting signal becomes abnormally long; the first and/or second detection circuit detects the abnormality, and then the stop signal output circuit immediately outputs the recording stop signal in such a manner that, regardless of the subsequent operation of the microcomputer,:

(1) the first switch circuit stops the power supply to the thermal head;

(2) even when such a cause as a failure in the first switch circuit causes no realization of the stopping of the power supply, the second switch circuit stops the printing operation of the thermal head; and (3) similarly, even when such a cause as a failure in the first and second switch circuits causes no realization of the stopping of the power supply or the printing operation, the third switch circuit inhibits the substantial printing operation of the picture image.

Since such triple overheat preventing operation is carried out, the abnormal heating of the thermal head can be prevented with a considerably high reliability.

With such an arrangement as mentioned above, since the first to third switch circuits are very low in failure probability, the present invention is not limited in practical applications to the above example of using all the first to third switch circuits. That is, when only one or two of the first to third switch circuits are used, substantially the same overheat prevention effect of the thermal head can be realized. The system having such configuration is more reliable compared with the prior art abnormal heating prevention system which is controlled by software through a microcomputer.

Further, with regard to the detection circuits, so long as at least one of the above first and second detection circuits is employed, the cause of abnormal heating can be detected at least in the minimum level.

With an abnormal heating prevention system having such an arrangement as stated above, the system can be fabricated without involving significant increase in cost, and particularly when the aforementioned circuits are built in a custom integrated circuit (IC) by new custom IC techniques, the system can be fabricated without substantial increase in cost.

DESCRIPTION OF THE PREFERRED EMBODIMENTS

Figure 1:
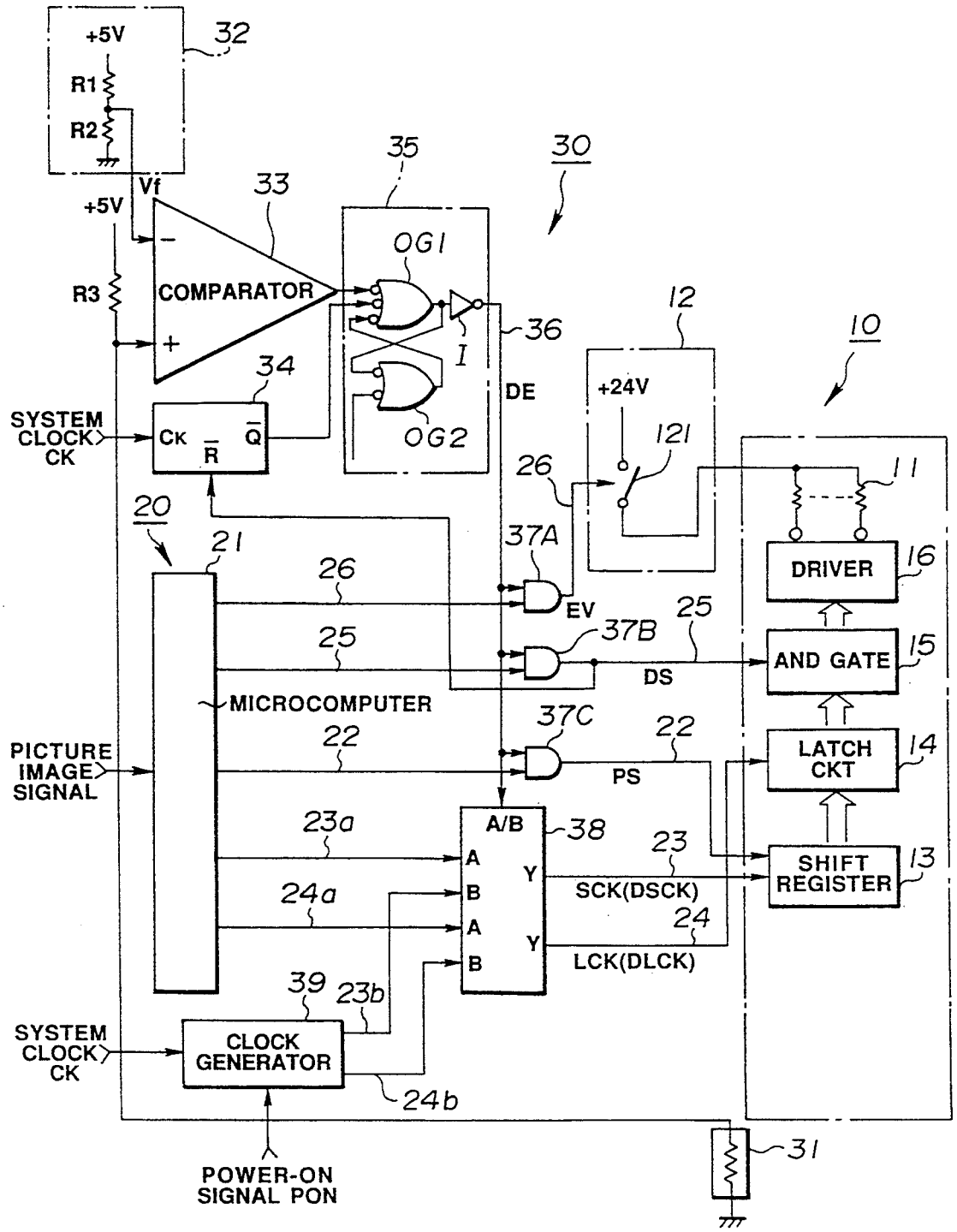
FIG. 1 is a circuit diagram of an entire arrangement of an abnormal heating prevention system in accordance with an embodiment of the present invention.

Referring first to FIG. 1, there is shown a system for preventing abnormal heating of a thermal head in accordance with an embodiment of the present invention.

More specifically, the system of FIG. 1 includes a thermal head part 10 for printing data onto thermal recording paper or ordinary paper through ink ribbon, a print controller 20 having a microcomputer 21 for controlling the printing operation of the thermal head part 10 through signal lines 22, 23, 24 and 25, and an abnormal-heating preventing part 30 disposed between the thermal head part 10 and the print controller 20 for preventing the thermal head park 10 from being abnormally heated.

Explanation will first be directed to the structure of the thermal head part 10. The detailed structure of the thermal head part 10 is shown in FIG. 2.

Figure 2:
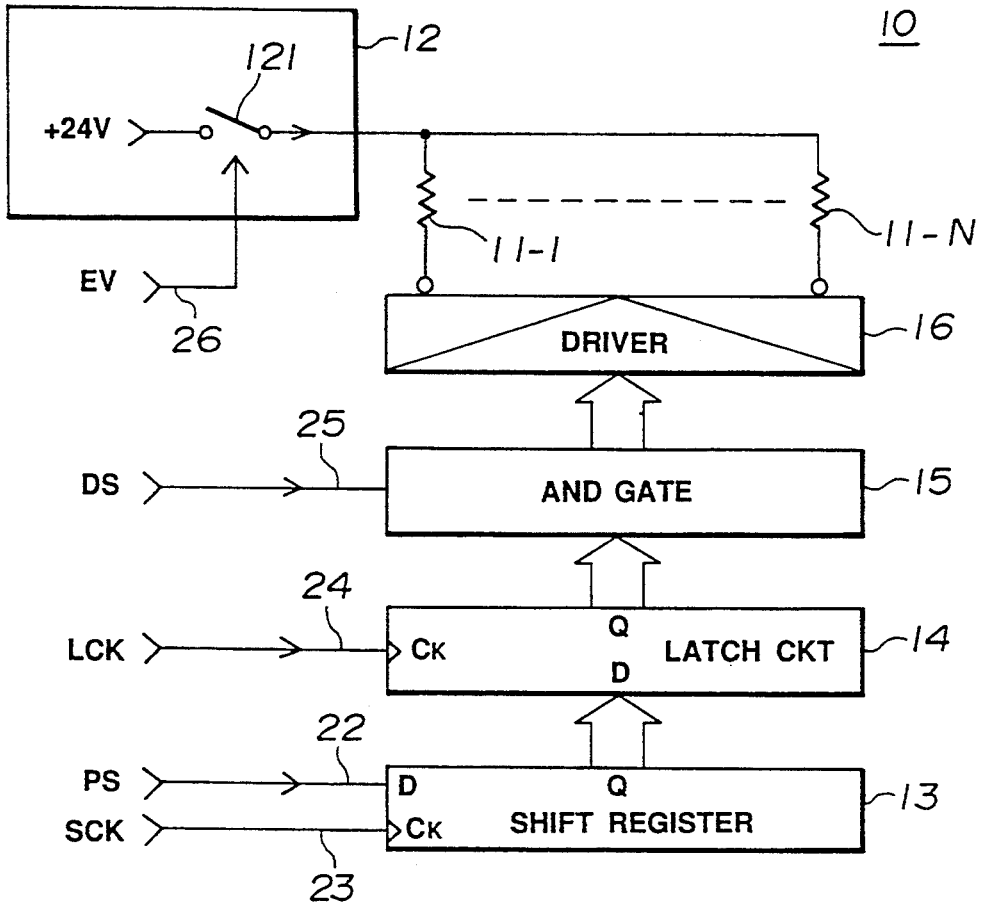
FIG. 2 is a block diagram of a detailed structure of a thermal head part in FIG. 1.

As shown in FIG. 2, the thermal head part 10 includes a heating resistor array 11 of resistors 11-1 to 11-N arranged to correspond in number to picture elements (pixels) corresponding to one line of picture image, a drive voltage supply circuit 12 for supplying a drive voltage of +24V to the respective heating resistors of the heating resistor array 11, a shift register 13 for serially receiving a picture image signal PS from the microcomputer 21 of the print controller 20 through the signal line 22 on the basis of a shift clock (data transfer clock) SCK received from the microcomputer 21 through the signal line 23 (23*a*), a latch circuit 14 for collectively latching the picture image signal PS corresponding to one line on the basis of a latch clock LCK received from the microcomputer 21 through the signal line 24 (24*a*) each time the shift register 13 stores therein the picture image signal PS corresponding to one line, an AND gate 15 for performing a logical "AND" operation of a print-time setting signal DS cyclically received from the microcomputer through the signal line 25 and the latched picture image signal PS corresponding to one line to enable only picture image signals having a logical level of "1") indicative of black pixels for a time period that is set by the print-time setting signal and that corresponds to a time necessary for the printing of one line of picture image, and a driver 16 for applying the drive voltage +24V to only ones of the heating resistors 11-1 to 11-N associated with the enabled picture image signals for the enabled time to allow them to be conductive and thus to be heated.

As shown also in FIG. 1, the drive voltage supply circuit 12 comprises a switch 121 which keeps the supply of the drive voltage +24V to the heating resistors 11-1 to 11-N during the reception of a power supply control signal EV from the microcomputer 21 through a signal line 26.

Referring again to FIG. 1, the abnormal-heating preventing part 30, which is disposed between the thermal head part 10 and the print controller 20 for controlling the thermal head 10 to prevent the thermal head 10 from being abnormal if heated, comprises a thermistor 31, a reference voltage output circuit 32 and a comparator 33 as means for detecting that the thermal head 10 is heated to a high temperature exceeding a predetermined level and also comprises a timer 34 as means for detecting that the enable time of the print-time setting signal DS applied to the thermal head part 10 through the signal line 25 becomes abnormal if long.

In more detail, the thermistor 31 is mounted on the thermal head part 10 at a proper location (usually, on its wiring circuit board) to output a voltage indicative of a temperature sensed thereby (more exactly, to decrease the resistance of the thermistor in proportion to the temperature to increase a current flowing therethrough , i.e., to increase a voltage drop across a resistor R3). The reference voltage output circuit 32 outputs, as a reference voltage Vf, a voltage set on the basis of the output of the thermistor 31 corresponding to a temperature which is regarded as an abnormally high temperature from experience. The comparator 33, which compares the output voltage of the thermistor 31 with the reference voltage Vf of the reference voltage output circuit 32, outputs a logical "H" level signal when the outpost voltage of the thermistor 31 does not exceed the reference voltage Vf and outputs a logical "L" level signal when the output voltage of the thermistor 31 exceeds the reference voltage Vf.

Meanwhile, the timer 34, which is set at a time (timer time) corresponding to the period time of the print-time setting signal DS or a time slightly larger than the Defied time, executes its time measuring operation during the active time of the print-time setting signal on the basis of a system clock CK of, for example, the associated thermal printer (facsimile machine), and each time the print-time setting signal DS is put in its inactive state, resets its measured time. The timer 34 is operated to output a logical level signal when the measured time does not reach the timer time and output a logical "L"

level signal when the measured time reaches the timer time.

Thus, when it is detected that the thermal head Dart was heated to a high temperature exceeding a predetermined level and that the active time of the print-time setting signal DS became abnormally long, such a condition can be judged, based on the above detected results, that the thermal head part 10 is going into an abnormally heated state. Accordingly, if the factors for heating the thermal head part 10 are cut off on the basis of the above judgment, it can be prevented that the thermal head part 10 is further heated. Such control of cutting the further heating of the thermal head is carried out by a flip-flop 35, AND gates 37 (37A, 37B and 37C) and a selector circuit 38, which structures and operations will be detailed below.

First of all, the flip-flop 35, which, comprises, 0R gates OG1 and OG2 and an inverter I as shown in FIG. 1, outputs a logical "H" level signal onto an output signal line 36 normally, i.e., when the outputs of the comparator 33 and timer 34 are both at their logical "H" level. When either one or both of the comparator 33 and the timer 34 outputs the logical "L" level signal, that is, when it is detected that the thermal head part 10 was heated to a high temperature exceeding the predetermined level or that the active time of the print-time setting signal DS became abnormally long; the flip-flop 35 outputs a logical "L" level signal. For the sake of easy explanation, the logical "L" level signal outputted onto the signal line 36 will be referred to as the "recording stop signal DE", hereinafter.

The AND gate 37A, which is connected to the signal line 26, acts to put the signal line 26 in its conductive state during the non-output of the recording stop signal DE, i.e., during the logical "H" level time of the signal of the signal line 36, and to put the signal line 26 into its non-conductive state when the recording stop signal DE is output. During the conductive state of the signal line 26, the power supply control signal EV issued from the microcomputer 21 enables the power supply control of the thermal head part 10 (the control of turning ON and OFF of the switch 121 in the drive voltage supply circuit 12). When the signal line 26 is put into the non-conductive state, however, the switch 121 is kept at its OFF state so that the drive signal +24V is not supplied to the thermal head part 10.

Further, the AND gate 37B, which is connected to the signal line 25, acts to put the signal line 25 into its conductive state during the non-output of the recording stop signal DE, and, to put the signal line 25 into its non-conductive state when the recording stop signal DE is output. During the conductive state of the signal line 25, the print-time setting signal DS issued from the microcomputer 21 enables the print-time setting of the thermal head part 10. When the signal line 25 is put in the non-conductive state, however, the print-time setting signal DS is also kept in the inactive state, which results in that the printing operation of the thermal head part 10 is also inhibited.

The AND gate 37C, which is connected to the signal line 22, acts to put the signal line 22 in its conductive state during the non-output of the recording stop signal DE, and to put the signal line 22 in its non-conductive state when the recording stop signal DE is output. During the conductive state of the signal line 22, the picture image signal PS issued from the microcomputer 21 is applied to the shift register 13 of the thermal head part 10. When the signal line 22 is put in the non-conductive state, however, the picture image signal PS is kept fully at its inactive level. That is, in the present embodiment, the signal PS is turned into a signal representing "white pixels", i.e., all not-printing pixels.

Finally, the selector circuit 38, which is connected at its output side to the signal lines 23 and 24 (terminals Y) and also connected at its input side to signal lines 23*a* and 24*a* (terminals A) and to signal lines 23*b* and 24*b* (terminals B), selects the signal lines 23*a* and 24*a* during the non-output of the recording stop signal DE to apply the shift clock SCK and the latch clock LCK issued from the microcomputer 21 to the shift register 13 and the latch circuit 14 of the thermal head part 10 respectively. On the other hand, when the recording stop signal DE is output, the selector circuit 38 selects the signal lines 23*b* and 24*b* to apply a pseudo shift clock DSCK and a pseudo latch clock DLCK to the shift register 13 and the latch circuit 14 of the thermal head part 10 respectively. In this connection, the pseudo shift clock DSCK is generated at a clock generator 39 based on the simulation of the aforementioned shift clock SCK, while the pseudo latch clock DLCK is generated at the clock generator 39 based on the simulation of the aforementioned latch clock LCK. As a result, even when the runaway or the like of the microcomputer 21 causes the stopping of the output of the aforementioned shift clock SCK and latch clock LCK, after the output of the recording stop signal DE, the picture image signal to be input to the thermal head part 10, that is, the picture image signal to be issued from the AND gate 37C as the signal indicative of "all white pixels" is positively sent into the thermal head part 10 under control of the pseudo shift clock DSCK and the pseudo latch clock DLCK. It goes without saying that the "all white pixels" are printed and the heating resistors 11-1 to 11-N will not actually be heated.

Figure 3:
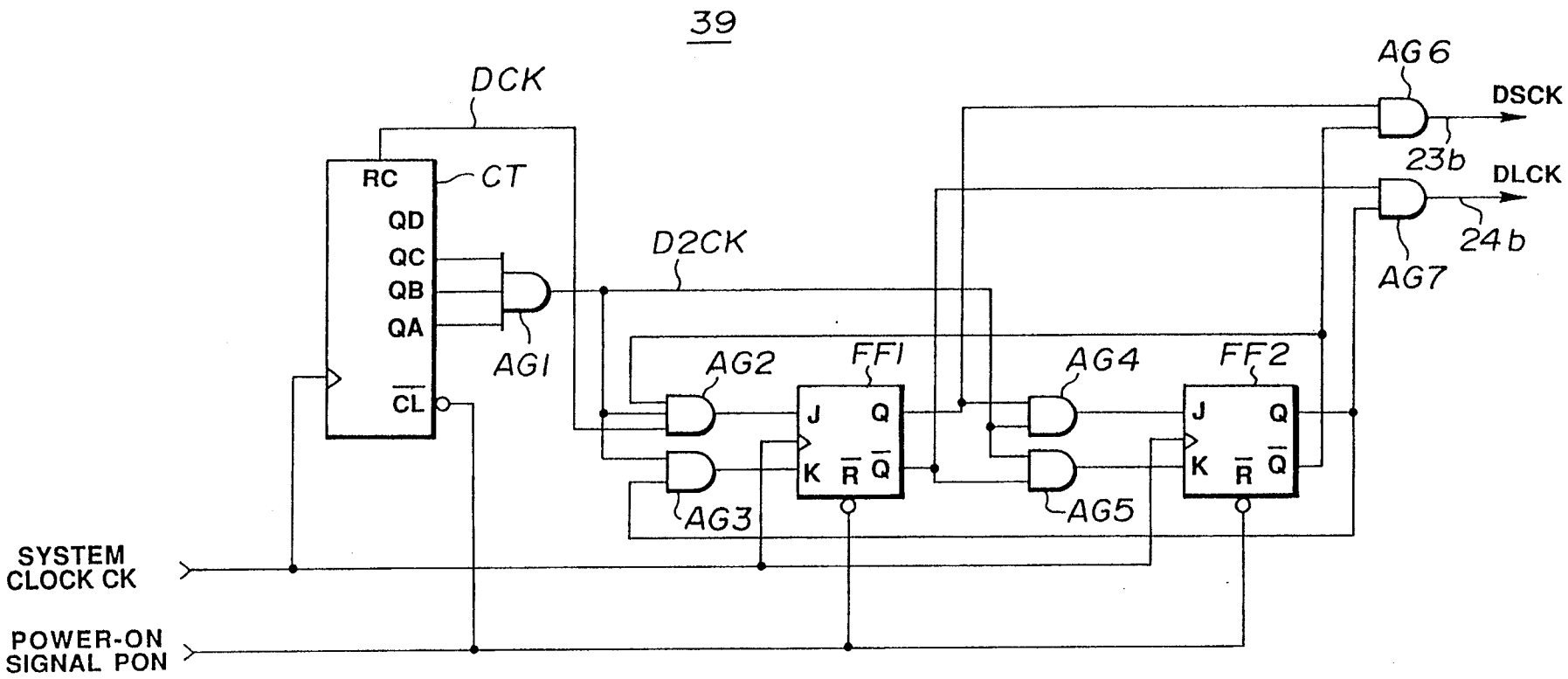
FIG. 3 is a circuit diagram of a specific example of a structure of a clock generator in FIG. 1.
Figure 4:
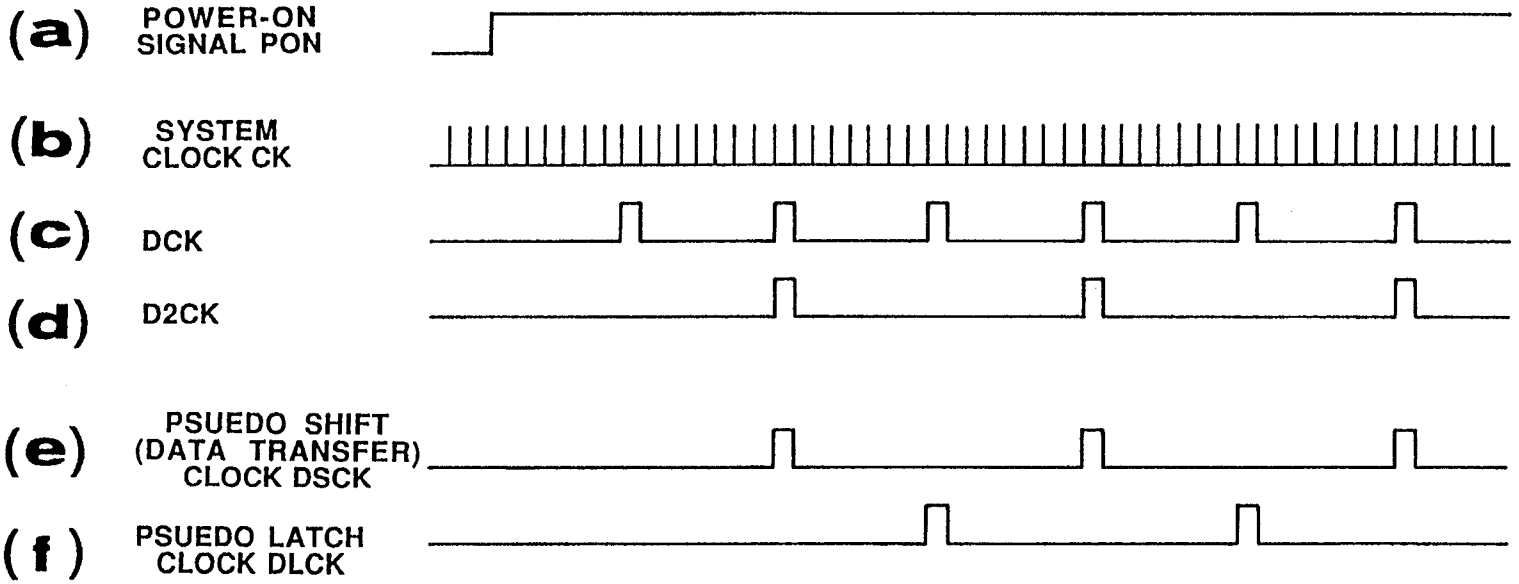
FIG. 4 is a timing chart for explaining the operation of the clock generator of FIG. 3.

FIG. 3 is a specific example of the structure of the clock generator 39 for generating the aforementioned pseudo clocks, while FIG. 4 is a timing chart for explaining the exemplary operation of the clock generator 39 of FIG. 3.

As shown in FIG. 3, the clock generator 39 comprises one counter CT, two JK flip-flops FF1 and FF2 and seven AND gates AG1 to AG7. In the clock generator 39, a power-on signal (refer to part (*a*) of FIG. 4) issued from the associated thermal printer (facsimile machine) causes the counter CT and the both flip flops FF1 and FF2 to be reset. After this, the basis of the system clock CK (refer to part (b) of FIG. 4) of the thermal printer (facsimile machine), the clock generator 39 generates signals DCK and D2CK (refer to FIGS. 4(*c*) and 4(*d*)) frequency-divided at predetermined ratios, and on the basis of these signals DCK and D2CK, generates as the pseudo shift clock DSCK and the pseudo latch clock DSCK such clock signals having alternately an active level as shown in parts (*e*) and (*f*) of FIG. 4.

Figure 5:
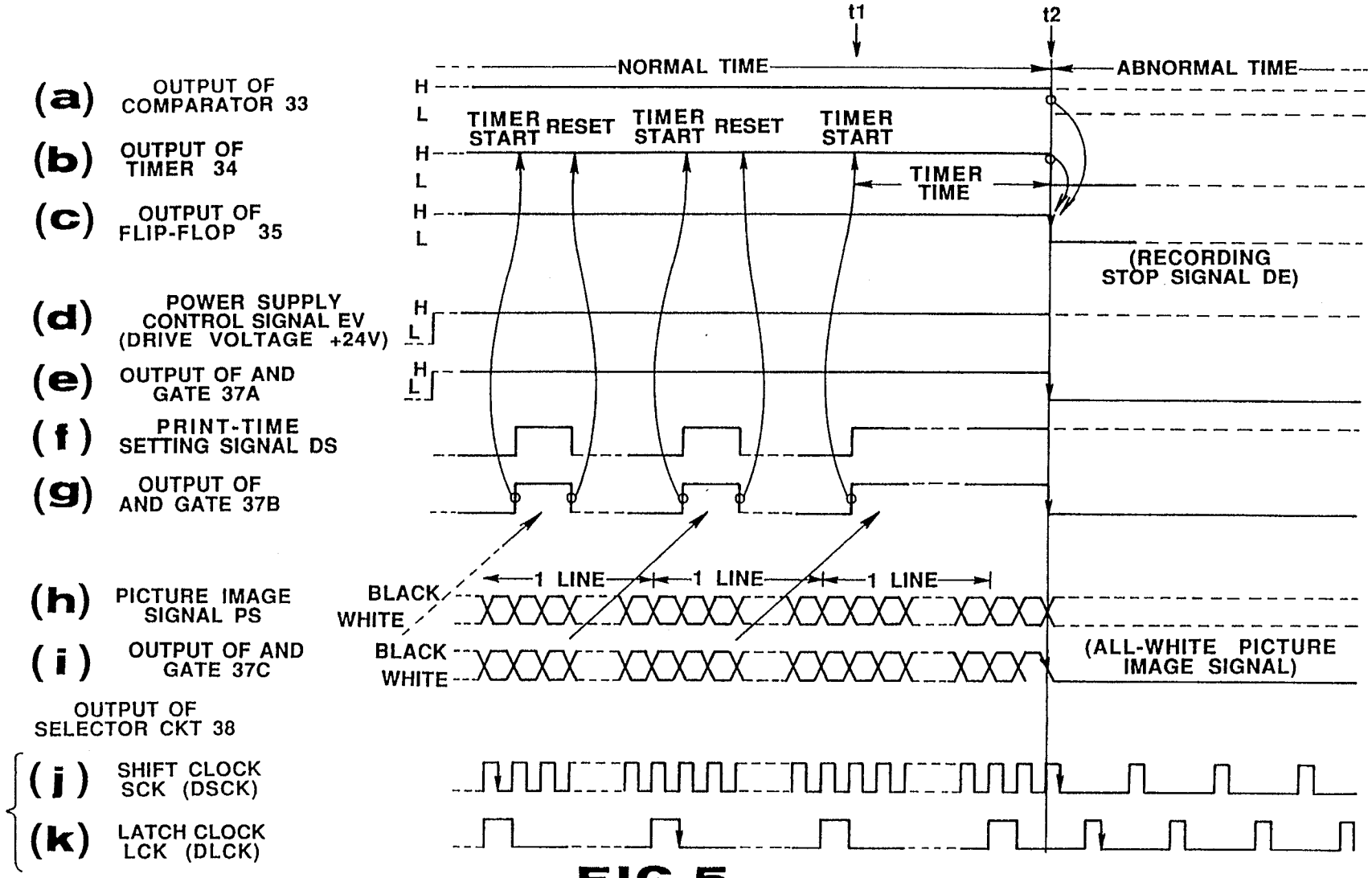
FIG. 5 is a timing chart for explaining the exemplary operation of the system of the embodiment of FIG. 1.

Shown in FIG. 5 is a timing chart for explaining an example of the operation of the embodiment of the above arrangement. The operation of the entire embodiment system will be detailed below by referring also to FIG. 5.

Assume now that the thermal Drinker is normally operating without generating any abnormal heating in the thermal head part 10. Under this circumstance, the output (refer to part (*a*) of FIG. 5) of the comparator 33 and the output (refer to part (*b*) of FIG. 5) of the timer 34 are both at logical "H" level, thus the output (refer to part (*c*) of FIG. 5) of the flip-flop 35 is also at logical "H" level, whereby the AND gates 37A to 37C are opened (to but the associated signal lines in the conductive state) and the selector circuit 38 is put into the A-input selection mode in which the signals input to the terminals A are selected. As a result, the embodiment system of FIG. 1 is operated as follows.

(*a*) The power supply control signal. EV, which is changed to the active state (logical "H" level), for example, when the signal receiving operation is started (in the case of a facsimile machine) or the power is turned ON, is applied from the microcomputer 21 through the signal line 26 to the drive voltage supply circuit 12, so that the switch 121 is turned to supply the drive voltage +24V to one ends of the heating resistors 11-1 to 11-N of the thermal head part 10 (refer to parts (*d*) and (*e*) of FIG. 5).

(*b*) The print-time setting signal DS, which is issued from the microcomputer 21 to become active (logical "H" level) cyclically for a predetermined time with respect to the printing operation of each line, is applied to the thermal head mart 10 through the signal line 25 so that the AND gate 15 is cyclically opened (in such a condition that the picture image signal indicative of black pixels causes the driver 16 to be driven) in synchronism with the timing of the signal DS refer to marts (*f*) and (*g*) of FIG. 5).

(*c*) The picture image signal PS, which is transferred through the printing operation, is applied from the microcomputer 21 through the signal line 22 to the thermal head mart 10 (refer to marts (*h*) and (*i*) of FIG. 5).

(*d*) The shift clock (data transfer clock) SCK issued from the microcomputer 21 is applied to the shift register 13 of the thermal head part 10 through the signal lines 23*a* and 23 refer to part (*j*) of FIG. 5).

(*e*) The latch clock LCK issued from the microcomputer is applied to the latch circuit 14 of the thermal head mart through the signal lines 24*a* and 24 (refer to part (*k*) of FIG. 5).

On the other hand, the thermal head part 10 itself repetitively executes the following operations (1) to (4) on the basis of these received signals.

(1) The picture image signal PS is serially applied to the shift register 13 in synchronism with the shift clock SCK refer to parts (*h*), (*i*) and (*j*) of FIG. 51.

(2) In synchronism with the latch clock LCK which becomes active when the picture image signal PS of one line is received, the picture image signal PS corresponding to one line previously stored in the shift register 13 is collectively parallelly latched by the latch circuit 14 (refer to FIGS. 5, (*h*), (*i*) and (*k*)).

(3) The AND gate 15 performs a logical "AND" of the latched picture image signal PS of one line and the print-time setting signal DS to put only the picture image signal (logical level "1" signal) indicative of black pixels into the active state for the time set by the print-time setting signal DS (refer to parts (*f*), (*g*), (*h*) and (*i*) of FIG. 5).

(4) Only for the active set time, the drive voltage +24V is applied to only ones of the heating resistors 11-1 to 11-N corresponding to the active picture image signal (black pixels) (put them in the conductive state) through the driver 16 to heat only the associated resistors.

During the printing operation of the thermal head part 10, if the print-time setting signal, which is intended to be normally active during each printing period, is maintained to be continuously active for some reason (refer to parts (*f*) and (*g*) of FIG. 5), then the occurrence of such an abnormality is detected when the continuous active time reaches the timer time set by the timer 34.

As already explained above, the timer 34 having the set time corresponding to the period time of the print-time setting signal DS or slightly larger than the period time is activated during the active time of the print-time setting signal DS (output of the AND gate 37B, in the present embodiment), i.e., at the rising edge of the print-time setting signal DS, whereas, the timer 34 is reset at the falling edge of the print-time setting signal DS to thereby measure the passage time on the basis of the system clock CK. In such an example as shown in FIG. 5, when the timer 34 is started at the rising edge of the print-time setting signal DS, i.e., at a time ti and reaches the timer time without being reset, i.e., at a time t2, the timer 34 detects that the active time of the print-time setting signal DS became abnormally long and outputs a logical "L" level signal (refer to part (*b*) of FIG. 5).

The output of the logical "L" level signal from the timer 34 causes the flip-flop 35 to be set so that the flip-flop 35 outputs a logical "L" level signal as the recording stop signal DE onto the output signal line 36 (refer to part (*c*) of FIG. 5). In this way, in such an embodiment system as shown in FIG. 1, when the flip-flop outputs the recording stop signal DE at the time t2 (refer to FIG. 5), this causes all the AND gates 37A to 37C to be closed (the associated signal lines being put in the non-conductive state) so that the selector circuit 38 is put in the B input selection mode in which the signals input to the terminals B are selected, after which the operation is carried out in the following manner.

(A) Even when the power supply control signal EV issued from the microcomputer 2I is at its active level, the AND gaze 37A causes the supply of the power supply control signal EV to the drive voltage supply circuit 12 to be interrupted (refer to parts (*d*) and (*e*) of FIG. 5).

(B) Even when the print-time setting signal DS issued from the microcomputer 21 is at its active level, the AND gate 37B causes the supply of the print-time setting signal DS to the thermal head part 10 (AND gate 15) to be interrupted (refer to parts (*f*) and (*g*) of FIG. 5).

(C) Even when the picture image signal PS is issued from the microcomputer 21, the AND gate 37C causes the supply of the signal PS to be interrupted and instead, a signal indicative of "all white pixels" or "all non-printing pixels" is sent to the thermal head part 10 (shift register 13) (refer to parts (*h*) and (*i*) of FIG. 5). Further, with respect to the shift clock and the latch clock, even when the shift clock SCK and the latch clock LCK are issued from the microcomputer 21 together with the aforementioned picture image signal PS, the pseudo shift clock DSCK and the pseudo latch clock DLCK generated from the clock generator 39 in place of the above signals are applied to the respective shift registers 13 and the latch circuit 14 of the thermal head part 10 (refer to parts (*j*) and (*k*) of FIG. 5).

In other words, the above operations (A) to (C) mean:

(1) The power supply to the thermal head part 10 is stopped regardless of the subsequent operation of the microcomputer 21.

(2) Even when the above stopping of the power supply cannot be realized for some reasons including a failure in the AND gate 37A or in the drive voltage supply circuit 12, the printing operation of the thermal head part 10 is stopped regardless of the subsequent operation of the microcomputer 21.

(3) Even when the above stopping of the power supply or the above stopping of the printing operation cannot be realized for some reason including a failure in the AND gates 37A and 37B or in the drive voltage supply circuit 12, the printing operation of the picture image is substantially inhibited regardless of the subsequent operation of the microcomputer 21.

In the operation (3), in particular, the heating resistors 11-1 to 1t-N of the thermal head part 10 are not actually heated at the time of printing "all white pixels" as already explained above.

In this way, in accordance with the system of the present embodiment, since the so-called triple overheat preventing operation as shown in (1) to (3) is carried out, the abnormal heating of the thermal head part 10 can be prevented at a considerably high reliability.

The above operation has been explained in connection with the case where the flip-flop 35 outputs the recording stop signal DE on the basis of the detection of the abnormally long active time of the print-time setting signal DS by the timer 34. In this case, since the temperature of the thermal head mart 10 is usually also increased when compared with the normal time, the comparator 33 can detect the occurrence of an abnormality substantially in such a manner as mentioned above.

In this case, in more detail, when the temperature of the thermal head part 10 increases for the above reason or other reasons, this causes the resistance value of the thermistor 31 to be decreased so that a current flowing through the thermistor 31 is increased, thus increasing the voltage drop across the resistor R3. For this reason, when the voltage drop across the resistor R3 exceeds the reference voltage Vf as the output of the reference voltage output circuit 32, the comparator 33 outputs a logical "L" level signal. The output of the logical "L" level signal from the comparator 33 causes the flip-flop 35 to be also set (if not yet set) so that the flip-flop 35 outputs a logical "L" level signal as the recording stop signal DE as in the above case (refer to part (*c*) of FIG. 5).

Since the detection of the abnormally high temperature of the thermal head exceeding the predetermined level as well as the detection of the abnormally long active time of the print-time setting signal by means of the comparator 33 and the timer 34 are carried out independently of their circuits, these detections are not always performed at the same time. In the present embodiment, since such different two sorts of abnormality detections are parallelly carried out, an abnormality detection accuracy can be largely improved. In practical applications, only one of the comparator 33 and the timer 34 may be provided. In this case, the flip-flop 35 is omitted and the output of the comparator 33 or the timer 34 is connected directly to the signal line 36.

With regard to the AND gates 37A, 37B, 37C and the selector circuit 38, since they have very low failure probabilities, the present invention is not limited to the aforementioned arrangement of the foregoing embodiment but in practical applications, some of these elements may be omitted as necessary. Assuming that the AND gate 37A is a first switch circuit, the AND gate 37B is a second switch circuit, and the AND gate 37C and the selector circuit 38 make up a third switch circuit, then one or two of the first to third switch circuits may be used in the present invention, in which case substantially the same abnormal heating prevention effect of the thermal head can be obtained as mentioned above.

With the abnormal heating prevention system having such an arrangement, when the above respective circuits are built in an existing custom integrated circuit (IC) especially new custom IC techniques, the system can be fabricated without substantially involving a remarkable increase in the cost.

Although the clock generator 39 has been arranged as shown in FIG. 3 to generate such pseudo shift clock DSCK and pseudo latch clock DLCK as shown in the parts (*e*) and (*f*) of FIG. 4 for the simplification of explanation in the foregoing embodiment, this is merely an example. Thus a circuit of any arrangement may be employed so long as the circuit can send the picture image signal PS ("all white pixels" signal, in this case) to the shift register 13 of the thermal head Dart 10 and also the sent picture image signal PS can be latched at the latch circuit 14 of the thermal head part 10. Of course, the pseudo shift clock DSCK and the pseudo latch clock DLCK be generated from the clock generator may have substantially the same format (timing) as the shift clock SCK and the latch clock LCK issued from the microcomputer 21.

What is claimed is:

1. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal and a driver for applying the drive voltage to ones of the plurality of heating resistors corresponding to the active part of the picture image signal only for the active time to heat the ones of the plurality of heating resistors, the system comprising:

a temperature detecting element mounted on the thermal head for detecting a temperature of a thermal head to output a voltage indicative of the detected temperature;

reference voltage output means for outputting a voltage corresponding to a given temperature of the thermal head as a reference voltage;

a comparator for comparing the output voltage of the temperature detecting element with the reference voltage to output a signal having a first logical level when the output voltage of the temperature detecting element does not exceed the reference voltage and to output a signal having a second logical level when the output voltage of the temperature detecting element exceeds the reference voltage;

a switch connected to the drive voltage supply circuit for maintaining supply of the drive voltage to the heating resistor array only during output of a power supply control signal from the microcomputer through a fifth signal line; and a gate connected to the fifth signal line for opening the fifth signal line during output of the signal having the first logical level from the comparator and for closing the fifth signal line when the signal having the second logical level is output from the comparator.

2. An abnormal heating prevention system as set forth in claim 1, further comprising a gate connected to the fourth signal line for opening the fourth signal line during output of the signal having the first logical level from the comparator and for closing the fourth signal line when the signal having the second logical level is output from the comparator.

3. An abnormal heating prevention system as set forth in claim 1, further comprising a gate connected to the first signal line for opening the first signal line during output of the signal having the first logical level from the comparator and for closing the first signal line when the signal having the second logical level is output from the comparator, a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line, and a selector circuit connected to the second and third signal lines for selectively outputting the shift clock and the latch clock issued from the microcomputer respectively to the second and third signal lines during output of the signal having the first logical level from the comparator and for selectively outputting the pseudo shift clock and the pseudo latch clock generated from the clock generator respectively to the second and third signal lines when the signal having the second logical level is issued from the comparator.

4. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the matched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a temperature detecting element mounted on the thermal head at a suitable position for detecting a temperature of the thermal head to output a voltage indicative of a detected temperature;

reference voltage output means for outputting a voltage corresponding to a given temperature of the thermal head as a reference voltage;

a comparator for comparing the output voltage of the temperature detecting element with the reference voltage to output a signal having a first logical level when the output voltage of the temperature detecting element does not exceed the reference voltage and to output a signal having a second logical level when the output voltage of the temperature detecting element exceeds the reference voltage; and a gate connected to the fourth signal line for opening the fourth signal line during output of the signal having the first logical level from the comparator and for closing the fourth signal line when the signal having the second logical level is issued from the comparator.

5. An abnormal heating prevention system as set forth in claim 4, further comprising a gate connected to the first signal line for opening first signal line during the output of the signal having the first logical level from the comparator and for closing the first signal line when the signal having the second logical level is output from the comparator, a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line, and a selector circuit connected to the second and third signal lines for selectively outputting the shift clock and the latch clock issued from the microcomputer respectively to the second and third signal lines during output of the signal having the first logical level from the comparator and for selectively outputting the pseudo shift clock and the pseudo latch clock generated from the clock generator respectively to the second and third signal lines when the signal having the second logical level is issued from the comparator.

6. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the matched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a temperature detecting element mounted on the thermal head for detecting a temperature of the thermal head to output a voltage indicative of a detected temperature;

reference voltage output means for outputting a voltage corresponding to a given temperature of the thermal head as a reference voltage;

a comparator for comparing the output voltage of the temperature detecting element with the reference voltage to output a signal having a first logical level when the output voltage of the temperature detecting element does not exceed the reference voltage and to output a signal having a second logical level when the output voltage of the temperature detecting element exceeds the reference voltage; and a gate connected to the fourth signal line for opening the fourth signal line during output of the signal having the first logical level from the comparator and for closing the fourth signal line when the signal having the second logical level is issued from the comparator.

a clock generator foe generating a pseudo shift clock that corresponds to a simulation of a shift clock issued from the microcmputer through the second signal line and also for generating a pseudo latch clock that corresponds to a simulation of a latch clock issued from he microcomputer through the third signal line; and a selector circuit connected to the second and third signal lines for selectively outputting the shift clock and latch clock issued from the microcomputer respectively to the second and third signal lines during output of the signal having the first a logical level from the comparator and or selectively outputting the pseudo shift clock and pseudo latch clock generated from the clock generator respectively to the second and third signal liens when he signal having the second logical level is issued from the comparator.

7. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a timer having a timer time set at a period time of the print-time setting signal of at a time slightly larger than the period time, for performing a time measuring operation during the active time the print-time setting signal, for resetting the time measuring operation each time the print-time setting signal becomes inactive, for outputting a signal having a first logical level when a measured time does not reach the timer time, and for outputting a signal having a second logical level when a measured time reaches the timer time;

a switch connected to the drive voltage supply circuit for maintaining supply of the drive voltage to the heating resistor array only during output of a power supply control signal from the microcomputer through a fifth signal line; and a gate connected to the fifth signal line for opening the fifth signal line during output of the signal having the first logical level from the timer and or closing he fifth signal lien when the signal having the second logical level is output from the timer.

8. An abnormal heating prevention system as set forth in claim 7, further comprising a gate connected to the fourth signal line for opening the fourth signal line during the output of the signal having the first logical level from the timer and for closing the fourth signal line when the signal having the second logical level is output from the timer.

9. An abnormal heating prevention system as set forth in claim 8, wherein the timer receives the print-time setting signal for triggering a time measuring operation and a resetting operation from an out, put of the gate connected to the fourth signal line.

10. An abnormal heating prevention system as set forth in claim 7, further comprising a gate connected to the first signal line for opening the first signal line during the output of the signal having the first logical level from the timer and for closing the first signal line when the signal having the second logical level is output from the timer, a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line, and a selector circuit connected to the second and third signal lines for selectively outputting the shift clock and latch clock issued from the microcomputer respectively to the second and third signal lines during the output of the signal having the first logical level from the timer and for selectively outputting the pseudo shift clock and pseudo latch clock generated from the clock generator respectively to the second and third signal lines when the signal having the second logical level is issued from the timer.

11. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a timer having a timer time set at a period time of the print-time setting signal or at a time slightly larger than the period time, for performing a time measuring operation during the active time of the print-time setting signal, for resetting the time measuring operation each time the print-time setting signal becomes inactive, for outputting a signal having a first logical level when a measured time does not reach the timer time, and for outputting a signal having a second logical level when the measured time reaches the timer time; and a gate connected to the fourth signal line for opening the fourth signal line during output of the signal having the first logical level from the timer and for closing the fourth signal line when the signal having the second logical level is output from the timer.

12. An abnormal heating prevention system as set forth in claim 11, wherein the timer receives the print-time setting signal for triggering the time measuring operation and resetting operation from an output of the gate connected to the fourth signal line.

13. An abnormal heating prevention system as set forth in claim 11, further comprising a gate connected to the first signal line for opening the first signal line during the output of the signal having the first logical level, from the timer and for closing the first signal line when the signal having the second logical level is output from the timer, a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line, and a selector circuit connected to the second and third signal lines for selectively outputting the shift clock and latch clock issued from the microcomputer respectively to the second and third signal lines during the output of the signal having the first logical level from the timer and for selectively outputting the pseudo shift clock and pseudo latch clock generated from the clock generator respectively to the second and third signal lines when the signal having the second logical level is issued from the timer.

14. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a temperature detecting element mounted on the thermal head for detecting a temperature of the thermal head to output a voltage indicative of a detected temperature;

reference voltage output means for outputting a voltage corresponding to a given temperature of the thermal head as a reference voltage;

a comparator for comparing the output voltage of the temperature detecting element with the reference voltage to output signal having a first logical level when the output voltage of the temperature detecting element does not exceed the reference voltage and to output a signal having a second logical level when the output voltage of the temperature detecting element exceeds the reference voltage;

a timer having a timer time set at a period time of the print-time setting signal or at a time slightly larger than the period time, for performing a time measuring operation during the active time of the print-time setting signal, for resetting the time measuring operation each time the print-time setting signal becomes inactive, for outputting a signal having the first logical level when a measured time does not reach the timer time, and for outputting a signal having the second logical level when the measured time reaches the timer time;

a flip-flop for outputting a signal having first logical level during output of the signals having the first logical level from the comparator and the timer and for outputting a signal having a second logical level when the signal having the second logical level is issued from one or both of the comparator and the timer;

a switch connected to the drive voltage supply circuit for maintaining supply of the drive voltage to the heating resistor array only during output of a power supply control signal from the microcomputer through a fifth signal line; and a gate connected to the fifth signal line for opening the fifth signal line when the signal having the first logical level is output from the flip-flop and for closing the fifth signal line when the signal having the second logical level is output from the flip-flop.

15. An abnormal heating prevention system as set forth in claim 14, further comprising a gate connected to the fourth signal line for opening the fourth signal line when the signal having the first output from the flip-flop and for closing the fourth signal line when the signal having the second logical level is output from the flip-flop.

16. An abnormal heating prevention system as set forth in claim 15, wherein the timer receives the print-time setting signal for triggering the time measuring operation and resetting operation from an output of the gate connected to the fourth signal line.

17. An abnormal heating prevention system as set forth in claim 14, further comprising a gate connected to the first signal line for opening the first signal line when the signal having the first logical level is output from the flip-flop and for closing the first signal line when the signal having the second logical level is output from the flip-flop, a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line, and a selector circuit connected to the second and third signal lines for selectively outputting the shift clock and latch clock issued from the microcomputer respectively to the second and third signal lines when the signal having the first logical level is output from the flip-flop and for selectively outputting the pseudo shift clock and pseudo latch clock generated from the clock generator respectively to the second and third signal lines when the signal having the second logical level is issued from the flip- flop.

18. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a temperature detecting element mounted on the thermal head for detecting a temperature of the thermal head to output a voltage indicative of a detected temperature;

reference voltage output means for outputting a voltage corresponding to a given temperature of the thermal head as a reference voltage;

a comparator for comparing the output voltage of the temperature detecting element with the reference voltage to output a signal having a first logical level when the output voltage of the temperature detecting element does not exceed the reference voltage and to output a signal having a second logical level when the output voltage of the temperature detecting element exceeds the reference voltage;

a timer having a timer time set at a period time of the print-time setting signal or at a time slightly larger than the period time, for performing a time measuring operation during the active time of the print-time setting signal, for resetting the time measuring operation each time the print-time setting signal becomes inactive, for outputting a signal having a first logical level when a measured time does not reach the timer time, and for outputting a signal having a second logical level when the measured time reaches the timer time;

a flip-flop for outputting a signal having a first logical level when the signals having the first logical level are output from the comparator and the timer and for outputting a signal having a second logical level when the signal having the second logical level is issued from one or both of the comparator and timer; and a gate connected to the fourth signal line for opening the fourth signal line when the signal having the first logical level is output from the flip-flop and for closing the fourth signal line when the signal having the second logical level is output from the flip-flop.

19. An abnormal heating prevention system as set forth in claim 18, wherein the timer receives the print-time setting signal for triggering its time measuring operation and its resetting operation from an output of the gate connected to, the fourth signal line.

20. An abnormal heating prevention system as set forth in claim 18, further comprising a gate connected to the first signal line for opening the first signal line during the output of the signal having the first logical level from the flip-flop and for closing the first signal line when the signal having the second logical level is output from the flip-flop, a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line, and a selector circuit connected to the second and third signal lines for selectively outputting the shift clock and the latch clock issued from the microcomputer respectively to the second and third signal lines during the output of the signal having the first logical level from the flip-flop and for selectively outputting the pseudo shift clock and pseudo latch clock generated from the clock generator respectively to the second and third signal lines when the signal having the second logical level is issued from the flip-flop.

21. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising a temperature detecting element mounted on the thermal head for detecting a temperature of the thermal head to output a voltage indicative of a detected temperature;

reference voltage output means for outputting a voltage corresponding to a given temperature of the thermal head as a reference voltage;

a comparator for comparing the output voltage of the temperature detecting element with the reference voltage to output a signal having a first logical level when the output voltage of the temperature detecting element does not exceed the reference voltage and to output a signal having a second logical level when the output voltage of the temperature detecting element exceeds the reference voltage;

a timer having a timer time set at a period time of the print-time setting signal or at a time slightly larger than the period time, for performing a time measuring operation during the active time of the print-time setting signal, for resetting the time measuring operation each time the print-time setting signal becomes inactive, for outputting a signal having a first logical level when a measured time does not reach the timer time, and for outputting a signal having a second logical level when the measured time reaches the timer time;

a flip-flop for outputting a signal having the first logical level when the signals having the first logical level are output from the comparator and the timer and for outputting a signal having the second logical level when the signal having the second logical level is issued from one or both of the comparator and the timer;

a gate connected to the first signal line for opening the first signal line when the signal having the first logical level is output from the flip-flop and for closing the first signal line when the signal having the second logical level is output from the flip-flop;

a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line; and a selector circuit connected to the second and third signal lines for selectively outputting the shift clock and latch clock issued from the microcomputer respectively to the second and third signal lines when the signal having the first logical level is output from the flip-flop and for selectively outputting the pseudo shift clock and pseudo latch clock generated from the clock generator respectively to the second and third signal lines when the signal having the second logical level is issued from the flip-flop.

22. An abnormal heating prevention system for preventing abnormal heating of a thermal head including a heating resistor array arranged as associated with picture elements of one line of a picture image, a drive voltage supply circuit for parallelly supplying a drive voltage to each of a plurality of heating resistors in the heating resistor array, a shift register for serially receiving a picture image signal from a printing control microcomputer through a first signal line based on a shift clock received from the microcomputer through a second signal line, a latch circuit for parallelly collectively latching the picture image signal of one line based on a latch clock received from the microcomputer through a third signal line, a gate array for performing a logical "AND" operation of a print-time setting signal cyclically received from the microcomputer through a fourth signal line and the latched picture image signal of one line to put only part of the picture image signal indicative of black pixels in an active state for an active time set by the print-time setting signal, and a driver for applying the drive voltage to ones of the plurality of heating resistors corresponding to the active part of the picture image signal only for the active time to heat the ones of the plurality of heating resistors, the system comprising:

a temperature detecting element mounted on the thermal head for detecting a temperature of the thermal head to output a voltage indicative of a detected temperature;

reference voltage output means for outputting a voltage corresponding to a given temperature of the thermal head as a reference voltage;

a comparator for comparing the output voltage of the temperature detecting element with the reference voltage to output a signal having a first logical level when the output voltage of the temperature detecting element does not exceed the reference voltage and to output a signal having a second logical level when the output voltage of the temperature detecting element exceeds the reference voltage;

a timer having a timer time set at a period time of the print-time setting signal or at a time slightly larger than the period time, for performing a time measuring operation during the active time of the print-time setting signal, for resetting the time measuring operation each time the print-time setting signal becomes inactive, for outputting a signal having a first logical level when a measured time does not reach the timer time, and for outputting a signal having a second logical level when the measured time reaches the timer time;

a flip-flop for outputting a signal having a first logical level when the signals having the first logical level are output from the comparator and the timer and for outputting a signal having a second logical level when the signal having the second logical level is issued from one or both of the comparator and the timer;

a switch connected to the drive voltage supply circuit for maintaining supply of the drive voltage to the heating resistor array only during output of a power supply control signal from the microcomputer through a fifth signal line;

a gate connected to the fifth signal line for opening the fifth signal line when the signal having the first logical level is output from the flip-flop and for closing the fifth signal line when the signal having the second logical level is output from the flip-flop;

a gate connected to the fourth signal line for opening the fourth signal line when the signal having the first logical level is output from the flip-flop and for closing the fourth signal line when the signal having the second logical level is output from the flip-flop;

a gate connected to the first signal line for opening the first signal line when the signal having the first logical level is output from the flip-flop and for closing the first signal line when the signal having the second logical level is output from the flip-flop;

a clock generator for generating a pseudo shift clock that corresponds to a simulation of a shift clock issued from the microcomputer through the second signal line and also for generating a pseudo latch clock that corresponds to a simulation of a latch clock issued from the microcomputer through the third signal line; and a selector circuit connected to the second and third signal lines for selectively outputting the shift clock and latch clock issued from the microcomputer respectively to the second and third signal lines when the signal having the first logical level is output from the flip-flop and for selectively outputting the pseudo shift clock and pseudo latch clock generated from the clock generator respectively to the second and third signal lines when the signal having the second logical level is issued from the flip-flop.

23. An abnormal heating prevention system as set forth in claim 22, wherein the timer receives the print-time setting signal for triggering the time measuring operation and its resetting operation from an output of the gate connected to the fourth signal line.

24. An abnormal heating prevention system for preventing abnormal heating of a thermal head, comprising:

a first detection circuit for detecting an abnormal high temperature of a thermal head exceeding a predetermined temperature;

a second detection circuit for detecting that an active time of a print-time setting signal issued cyclically from a printing control microcomputer to be active for a time period necessary for printing of one line of a picture image becomes abnormally long;

a stop signal output circuit, when one or both of the first and second detection circuits detect an abnormality, for triggering to output a recording stop signal;

a first switch circuit for forcibly stopping supply of a drive voltage from a power supply to the thermal head in response to an output of the recording stop signal;

a second switch circuit for forcibly stopping input of the print-time setting signal to the thermal held in response to the output of the recording stop signal; and a third switch circuit for cutting off supply of a picture image signal from the microcomputer to the thermal head in response to the output of the recording stop signal and for forcibly supplying, instead of the picture image signal from the microcomputer, a signal indicative of a non-printing picture image to the thermal head as the picture image signal.

25. An abnormal heating prevention system for preventing abnormal heating of a thermal head, comprising:

a detection circuit for detecting an occurrence of an abnormal heating factor in a thermal head;

a shop signal output circuit, when the detection circuit detects the occurrence of the abnormal heating factor, for triggering to output a recording stop signal; and a switch circuit for forcibly putting control elements of the thermal head in an inactive state under control of a printing control microcomputer when the shop signal output circuit outputs the recording stop signal.

26. An abnormal heating prevention system as set forth in claim 25, wherein the detection circuit comprises one or both of a first detection circuit for detecting an abnormal high temperature of the thermal head exceeding a predetermined temperature and a second detection circuit for detecting that an active time of a print-time setting signal cyclically issued from the printing control microcomputer to be active for a constant time necessary for printing of one line of picture image becomes abnormally long.

27. An abnormal heating prevention system as set forth in claim 25, wherein the switch circuit comprises one or some of three of a first switch circuit for forcibly stopping supply of a drive voltage from a power supply to the thermal head in response to an output of the recording stop signal, a second switch circuit for forcibly stopping input of the print-time setting signal cyclically issued from the microcomputer to the thermal head to be active for a constant time necessary for printing of one line of picture image in response to the output of the recording stop signal, and a third switch circuit for cutting off supply of a picture image signal from the microcomputer to the thermal head in response to the output of the recording stop signal and for forcibly supplying, instead of the picture image signal from the microcomputer, a signal indicative of a non-printing picture image to the thermal head as the picture image signal.

* * * * *

UNITED STATES PATENT AND TRADEMARK OFFICE

CERTIFICATE OF CORRECTION

PATENT NO. : 5,353,044

DATED : October 04, 1994

INVENTOR(S) : Akira Nakano et al

It is certified that error appears in the above-indentified patent and that said Letters Patent is hereby corrected as shown below:

Claim 4, Column 11, Line 60, change "matched" to --latched--.

Claim 5, Column 12, Line 26, delete "the".

Claim 6, Column 12, Line 62, change "matched" to --latched--.

Claim 6, Column 13, Line 18, delete "and".

Claim 6, Column 13, Line 19, change "fourth" to --first--.

Claim 6, Column 13, Line 20, change "fourth" to --first--.

Claim 6, Column 13, Line 22, change "fourth" to --first--.

Claim 6, Column 13, Line 27, change "microcmputer" to --microcomputer--.

Claim 6, Column 13, Line 30, change "he" to --the--.

Claim 6, Column 13, Line 37, delete "a".

UNITED STATES PATENT AND TRADEMARK OFFICE

CERTIFICATE OF CORRECTION

PATENT NO. : 5,353,044
DATED : October 04, 1994
INVENTOR(S) : Akira Nakano et al It is certified that error appears in the above-indentified patent and that said Letters Patent is hereby corrected as shown below:

Claim 6, Column 13, Line 38, change "or" to --for--.

Claim 6, Column 13, Line 41, change "he" to --the--.

Claim 7, Column 14, Line 19, change "or" to --for--.

Claim 7, Column 14, Line 20, change "he fifth signal lien" to --the fifth signal line--.

Claim 9, Column 14, Line 32, change "out, put" to --output--.

Claim 14, Column 16, Line 40, after "having" insert --a--.

Claim 15, Column 16, Line 60, after "first" insert --logical level is--.

Claim 17, Column 17, Line 22, change "flip- flop" to --flip-flop--

UNITED STATES PATENT AND TRADEMARK OFFICE

CERTIFICATE OF CORRECTION

PATENT NO. : 5,353,044

DATED : October 04, 1994

INVENTOR(S) : Akira Nakano et al

It is certified that error appears in the above-indentified patent and that said Letters Patent is hereby corrected as shown below:

Claim 19, Column 18, Line 24, delete --,--.

Claim 24, Column 21, Line 49, change "held" to --head--.

Claim 27, Column 22, Line 39, change "the" to --a--.

Signed and Sealed this

Twenty-sixth Day of December, 1995

*Attest:*

Bruce Lehman

BRUCE LEHMAN

*Attesting Officer*

*Commissioner of Patents and Trademarks*